US005576823A

United States Patent [19]

Kakuta et al.

[11] Patent Number: 5,576,823

[45] Date of Patent: Nov. 19, 1996

[54] AUTOMATIC DOCUMENT FEEDER HAVING DOCUMENT SEPARATING MECHANISM

[75] Inventors: Masayuki Kakuta; Ikuo Shigemitsu, both of Osaka, Japan

[73] Assignee: Mita Industrial Co., Ltd., Osaka, Japan

[21] Appl. No.: 517,622

[22] Filed: Aug. 22, 1995

[30] Foreign Application Priority Data

Sep. 1, 1994 [JP] Japan ..... 6-208760

[51] Int. Cl.[6] ..... G03G 21/00

[52] U.S. Cl. ..... 355/308; 271/126; 355/321

[58] Field of Search ..... 355/308, 309, 355/321; 271/126, 121, 37–38, 3.05, 10.09, 10.11, 10.13–10.16

[56] References Cited

U.S. PATENT DOCUMENTS 3,618,933 11/1971 Roggenstein et al. ..... 271/36
5,096,177 3/1992 Saeki et al. ..... 271/3.1
5,120,039 6/1992 Yamada ..... 271/4
5,344,134 9/1994 Saeki et al. ..... 271/10 X
5,465,949 11/1995 Yamada et al. ..... 271/126 X

FOREIGN PATENT DOCUMENTS 6-144658 5/1994 Japan .

*Primary Examiner*—Nestor R. Ramirez
*Attorney, Agent, or Firm*—Antonelli, Terry, Stout & Kraus

[57] ABSTRACT

An automatic document feeder includes a controller for actuating and controlling a document forwarder, a document separator, a resist roller pair, and a document conveyor. In response to a copy start signal, the controller energizes the pressing mechanism of the document forward, actuates the forwarding roller, and actuates the document separator to carry the document laid on the document bearing member. During the carriage of the document to bring its front end to the resist roller pair, the controller deenergizes the pressing mechanism of the document forwarder at least once for a predetermined time during a period from the arrival of the front end of the document at the document separator until its arrival at the resist roller pair, thereby releasing the pressure on the documents laid on document bearing member.

2 Claims, 12 Drawing Sheets

AUTOMATIC DOCUMENT FEEDER HAVING DOCUMENT SEPARATING MECHANISM

FIELD OF THE INVENTION

This invention relates to an automatic document feeder to be mounted on a document processor such as an electrostatic document copying machine or an image reader.

DESCRIPTION OF THE PRIOR ART

In recent years, with the speeding and automation of copying, copying machines have included an automatic document feeder which automatically feeds a plurality of documents sequentially to a document setting position on the top of a transparent panel. Such an automatic document feeder comprises a document bearing means for bearing documents; a forwarding means having a forwarding roller for forwardly delivering the documents borne on the document bearing means, and a pressing mechanism for pressing the documents at the time of document delivery by the forwarding roller; a document separating means having a paper feed roller disposed downstream of the forwarding means and rotated in the direction of conveyance, and a separating mechanism disposed opposite to the paper feed roller and operated in a direction opposite to the direction of conveyance; a resist roller pair disposed downstream of the document separating means to temporarily stop the document carried by the paper feed roller and to carry the stopped document toward a transparent panel of a document processor; and a document conveying means for conveying the document, carried by the resist roller pair, to a predetermined position on the transparent panel and discharging the document conveyed to the transparent panel. In response to a copy start signal, the pressing mechanism of the forwarding means is energized and the forwarding roller actuated. Simultaneously, the document separating means is actuated to carry the front end of the document borne on the document bearing means to the resist roller pair.

The pressing mechanism of the forwarding means is energized at the same time as the start of a copying action, and its energizing lasts for a so-called temporary paper feed period until the front end of the document reaches the resist roller pair. Thus, if two or more documents are borne on the document bearing means, the second or later document is stopped by the document separating means. At the forwarding means, however, such document is about to be carried toward the document separating means owing to its friction with the document beneath it which is being carried by the forwarding roller. In this situation, if the document borne on the document bearing means is thicker than an ordinary document and has high resistance, it slips against the lower document being carried, thus posing no problems. If the document being borne is thin, however, it will be carried by its friction with the lower document, thus undergoing a deflection relative to the document separating means. This deflection in turn makes wrinkles, damaging the document and causing a document jam.

SUMMARY OF THE INVENTION

The object of this invention is to provide an automatic document feeder which carries one by one a plurality of documents laid on a document bearing means, the feeder being capable of preventing the generation of wrinkles on the document during steps other than carriage and of preventing a document jam associated with wrinkles that develop on a document.

To attain the object, the present invention provides an automatic document feeder comprising a document bearing means for bearing documents; a forwarding means having a forwarding roller for forwardly delivering the documents borne on the document bearing means, and a pressing mechanism for pressing the documents at the time of document delivery by the forwarding roller; a document separating means having a paper feed roller disposed downstream of the forwarding means and rotated in the direction of conveyance, and a separating mechanism disposed opposite to the paper feed roller and operated in a direction opposite to the direction of conveyance; a resist roller pair disposed downstream of the document separating means to temporarily stop the document carried by the paper feed roller and carry the stopped document toward a transparent panel of a document processor; and a document conveying means for conveying the document, carried by the resist roller pair, to a predetermined position on the transparent panel and discharging the document conveyed to the transparent panel, wherein a controlling means for actuating and controlling the forwarding means, the document separating means, the resist roller pair, and the document conveying means is also included, in response to a copy start signal, the controlling means energizes the pressing mechanism of the forwarding means, actuates the forwarding roller, and actuates the document separating means to carry the document laid on the document bearing means, and during the carriage of the document to bring its front end to the resist roller pair, the controlling means deenergizes the pressing mechanism of the forwarding means at least once for a predetermined time during a period from the arrival of the front end of the document at the document separating means until its arrival at the resist roller pair, thereby releasing the pressure on the documents laid on the document bearing means.

The automatic document feeder constructed in accordance with the present invention enables the controlling means to energize the pressing mechanism of the forwarding means, actuate the forwarding roller, and actuate the document separating means in response to a copy start signal. When the pressing mechanism is energized, the documents laid on the document bearing means are pressed, whereby the actuation of the forwarding roller results in the delivery of the documents toward the document separating means. The documents sent to the document separating means are separated there, and only one of the documents is carried toward the resist roller pair. During a period from the arrival of the front end of the thus carried document at the document separating means until its arrival at the resist roller pair, the controlling means deenergizes the pressing mechanism of the forwarding means at least once for a predetermined time, thereby releasing the pressure on the documents laid on the document bearing means. Hence, in the case of a deflection occurring in the second or later document owing to its friction with the first document being carried, this friction is removed, so that the second or later document returns to its original shape owing to its elasticity before getting wrinkled.

DETAILED DESCRIPTION OF THE PREFERRED EMBODIMENTS

Preferred embodiments of an automatic document feeder constructed in accordance with the present invention will be described in detail by reference to the appended drawings.

Figure 1:
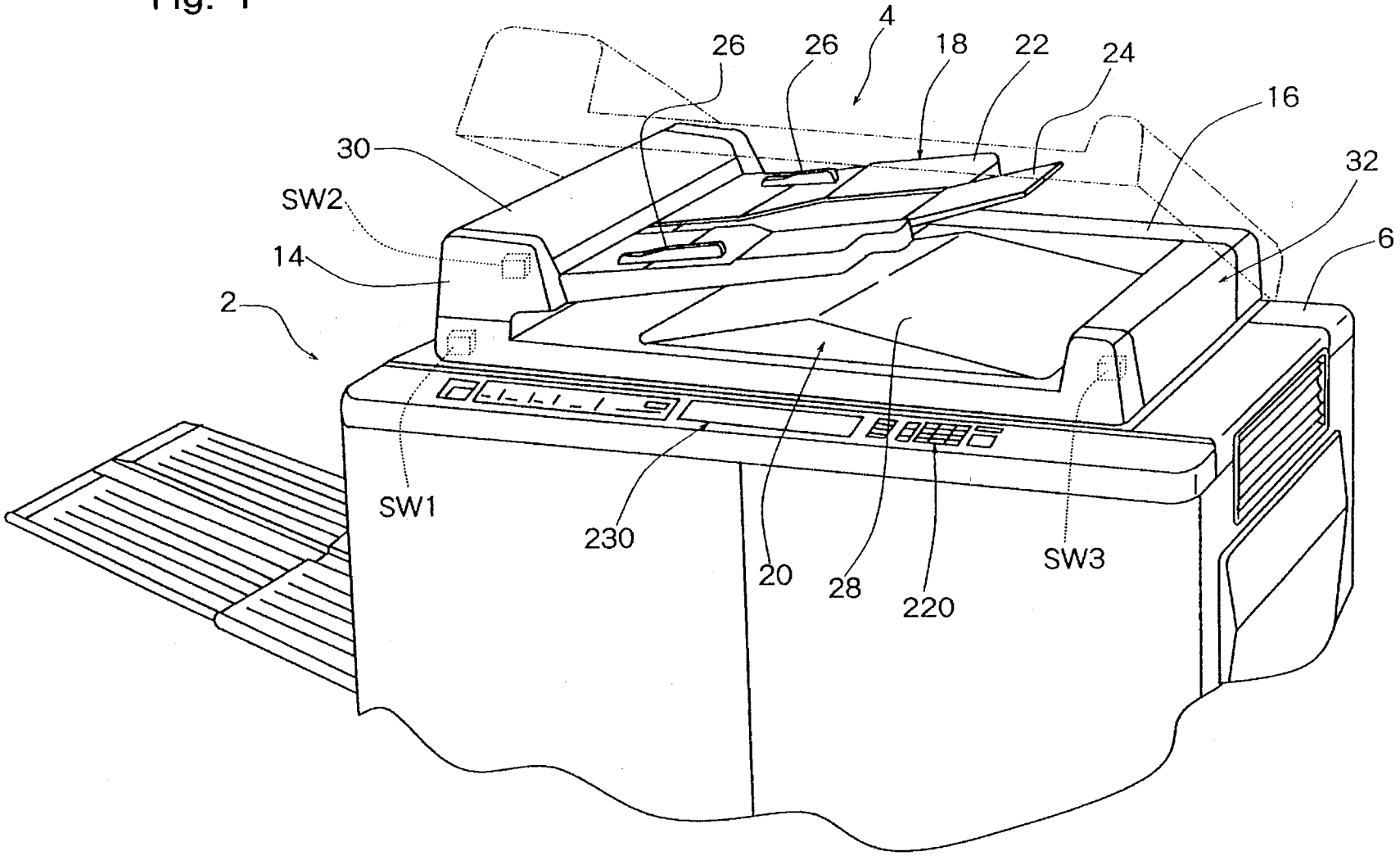
FIG. 1 is a perspective view showing an automatic document feeder constructed in accordance with the present invention mounted on an electrostatic document copying machine.
Figure 2:
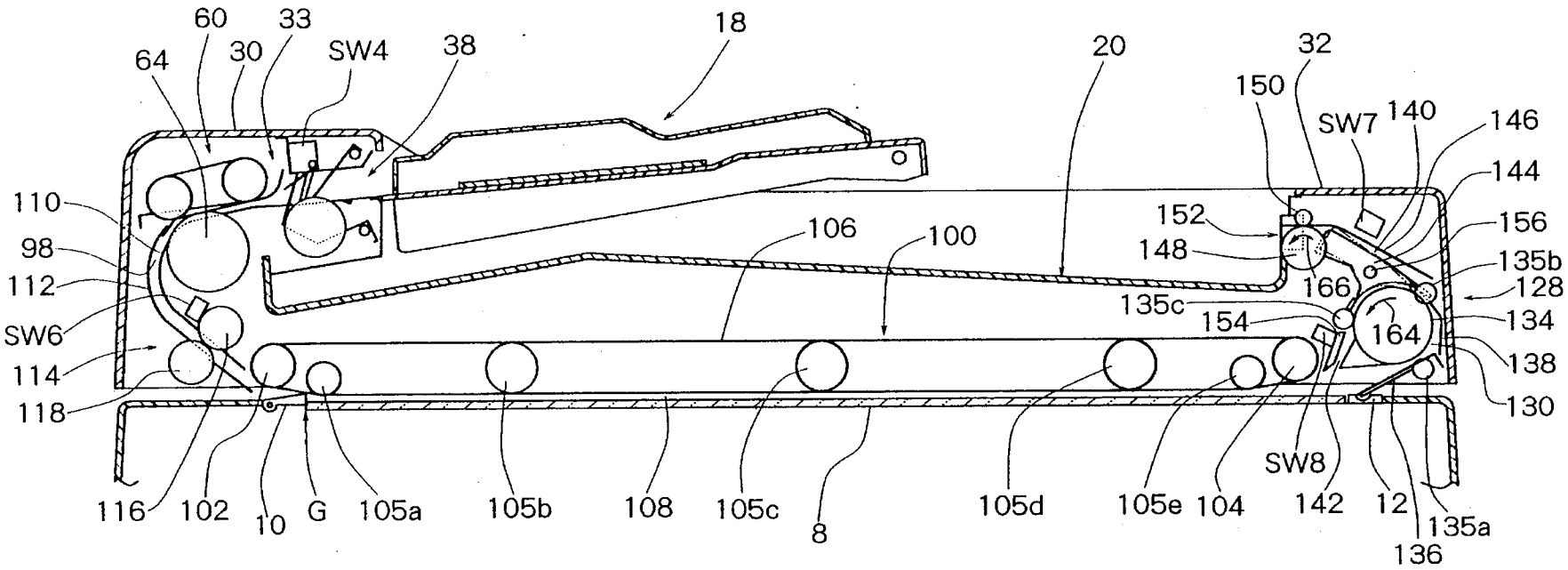
FIG. 2 is a sectional schematic view of the automatic document feeder shown in FIG. 1.

FIGS. 1 and 2 illustrate an upper end portion of an electrostatic document copying machine 2 and an automatic document feeder 4 mounted thereon. The electrostatic document copying machine 2 has a housing 6, on top of which is disposed a transparent panel 8 (FIG. 2), optionally being a glass plate. On one side of the transparent panel 8 (the left-hand side in FIG. 2) is disposed a document restraining member 10 which determines a standard position for document setting, G. On the other side of transparent panel 8 (the right-hand side in FIG. 2) is disposed a stationary mounting member 12. The automatic document feeder 4 constructed in accordance with the present invention is mounted on the top of the housing 6 of the electrostatic document copying machine 2 so as to be free to pivot between a closed position shown by a solid line in FIG. 1 and an open position shown by a two-dot chain line in FIG. 1 about a pivot axis extending along the rear side edge of the transparent panel 8. If a document is to be laid manually on the transparent panel 8 of the electrostatic document copying machine 2, the automatic document feeder 4 is brought to the open position to expose the transparent panel 8, and the document is placed at a required position on the transparent panel 8. Then, the automatic document feeder 4 is brought to the closed position to cover the transparent panel 8 and the document placed thereon. In laying the document on the transparent panel 8, one can set the document at the required position by contacting one edge of the document with the leading edge of the document restraining member 10 (the right-hand edge in FIG. 2) to bring the one edge of the document to the standard position G for document setting. When the automatic document feeder 4 is used to feed documents automatically onto the transparent panel 8 and feed them automatically out from there, the feeder 4 is brought to the closed position.

Further with reference to FIG. 1, the illustrated automatic document feeder 4 includes a front cover 14 and a rear cover 16 disposed at spaced apart locations in a front-to-back direction (the direction perpendicular to the sheet surface in FIG. 2). The front cover 14 and the rear cover 16 may be formed of a suitable plastic material. Inside the rear cover 16 is disposed a rear supporting base plate (not shown), which is mounted, via a mounting mechanism (not shown) optionally of a well-known shape per se, on the top of the housing 6 of the electrostatic document copying machine 2 so as to be free to pivot. Various constituent elements of the automatic document feeder 4 are supported directly or indirectly by the rear supporting base plate. Between the front cover 14 and the rear cover 16 is disposed a document bearing means 18 and a document discharge tray 20. The document bearing means 18 comprises a document table 22 which is inclined upwardly from the left-hand front end to the right-hand rear end thereof in FIG. 2, and an auxiliary table 24 pivotably mounted on the rear end of the document table 2. On the document table 22 are mounted a pair of width restricting members 26 movably in a width direction. Such a pair of width restricting members 26 are joined together, via a rack and pinion mechanism (not shown) which is well known per se, beneath the document table 22, and are moved toward and away from each other in an interlocked manner. The document discharge tray 20 is disposed below the document bearing means 18, and has a document bearing surface 28 shaped like a mountain when viewed from the front of copying machine 2 (i.e. in the direction perpendicular to the sheet surface in FIG. 2). Between the left end portions of the front cover 14 and the rear cover 16 is disposed a left end portion cover 30, while a right end portion cover 32 is disposed between their right end portions. Inside the front cover 14 are disposed a safety switch SW1 for detecting the open and closed states of the automatic document feeder 4, a safety switch SW2 for detecting the open and closed states of the left end portion cover 30, and a safety switch SW3 for detecting the open and closed states of the right end portion cover 32. These switches are disposed in series, and when the covers are in the closed position, all the switches are shut, and an ON signal is sent to a controlling means to be described later.

Further with reference to FIGS. 1 to 4, a document sending-in means 33, provided with a forwarding means 38 and a document separating mechanism 60, is disposed downstream of the document table 22. The document sending-in means 33 has a pair of stationary plates 34, 36 extending on the downstream side of the document table 22. Below the stationary plate 34 is disposed a forwarding roller 40 constituting a part of the forwarding means 38, and the forwarding roller 40 is situated so as to protrude slightly upwardly through an opening 42 formed on the upstream side of the stationary plate 34. Above the forwarding roller 40 is disposed a pressing mechanism 44 constituting another part of the forwarding means 38. The pressing mechanism 44 is comprised of a rotatably shaft 46 disposed rotatably, and a pressing plate 48 one end of which is fixed to the rotating shaft 46 and the other end of which acts on documents 50 inserted onto the stationary plate 34 after being placed on the document bearing means 18. The rotatable shaft 46 constituting part of the pressing mechanism 44 is connected to a solenoid SL1 via a link mechanism 52, so that when the solenoid SL1 is energized, the rotatable shaft 46 is rotated in the direction of an arrow 56 against the spring force of a return spring 54; whereas when the solenoid SL1 is deenergized, the shaft 46 is rotated in the direction of an arrow 58 owing to the spring force of the return spring 54. Thus, the pressing plate 48, attached to the rotatable shaft 46, presses the documents 50, which has been inserted onto the stationary plate 34, when the solenoid SL1 is energized to rotate the rotatable shaft 46 in the direction of arrow 56; and the pressing plate 48 is separated from the documents 50 when the solenoid SL1 is deenergized and the rotatable shaft 46 is rotated in the direction of arrow 58 by the action of the return spring 54. Above the stationary plate 34 is disposed a document setting switch SW4 as a document detecting means. The document setting switch SW4 sends an ON signal when the documents 50 are inserted onto the stationary plate 34 after being placed on the document bearing means 18, and an OFF signal when documents 50 are not on the document bearing means 18.

The document separating mechanism 60 disposed downstream of the forwarding means 38 is composed of a paper feed roller 64 having a plurality of rollers disposed downward of the stationary plate 34 and caused to protrude upwardly through an opening 62 formed in the stationary plate 34; and a separating belt mechanism 66 disposed above the paper feed roller 64 so as to face it. The separating belt mechanism 66 is disposed on the upward side of the stationary plate 36, and consists of a driving roller 67, a driven roller 68, and a plurality of separating belts 69 wound between the driving roller 67 and the driven roller 68 and disposed alternately with respect to the plurality of rollers constituting the paper feed roller 64. Each separating belt 69 is caused to protrude downwardly through an opening 75 formed in the stationary plate 36. The forwarding roller 40, the paper feed roller 64 and the separating belt mechanism 66 are rotationally driven in the directions of arrows 79, 80 and 82, respectively, by a driving means 78 comprising an electric motor M1 and a transmitting mechanism 76 such as a gear mechanism or an electric belt mechanism. To the electric motor M1 is mounted a rotational amount detecting means FG1, such as a rotary encoder or a frequency generator, which constitutes a means of detecting the amount of document conveyance. Pulse signals, as signals for indicating detection thereby, are sent to a controlling means to be described later. The so constituted document separating means 60 is adapted to prevent the simultaneous feed of two or more documents from a pile of documents laid on the document bearing means 18 and to feed only the lowermost document to a document sending-in path 98 to be described later.

Figure 3:
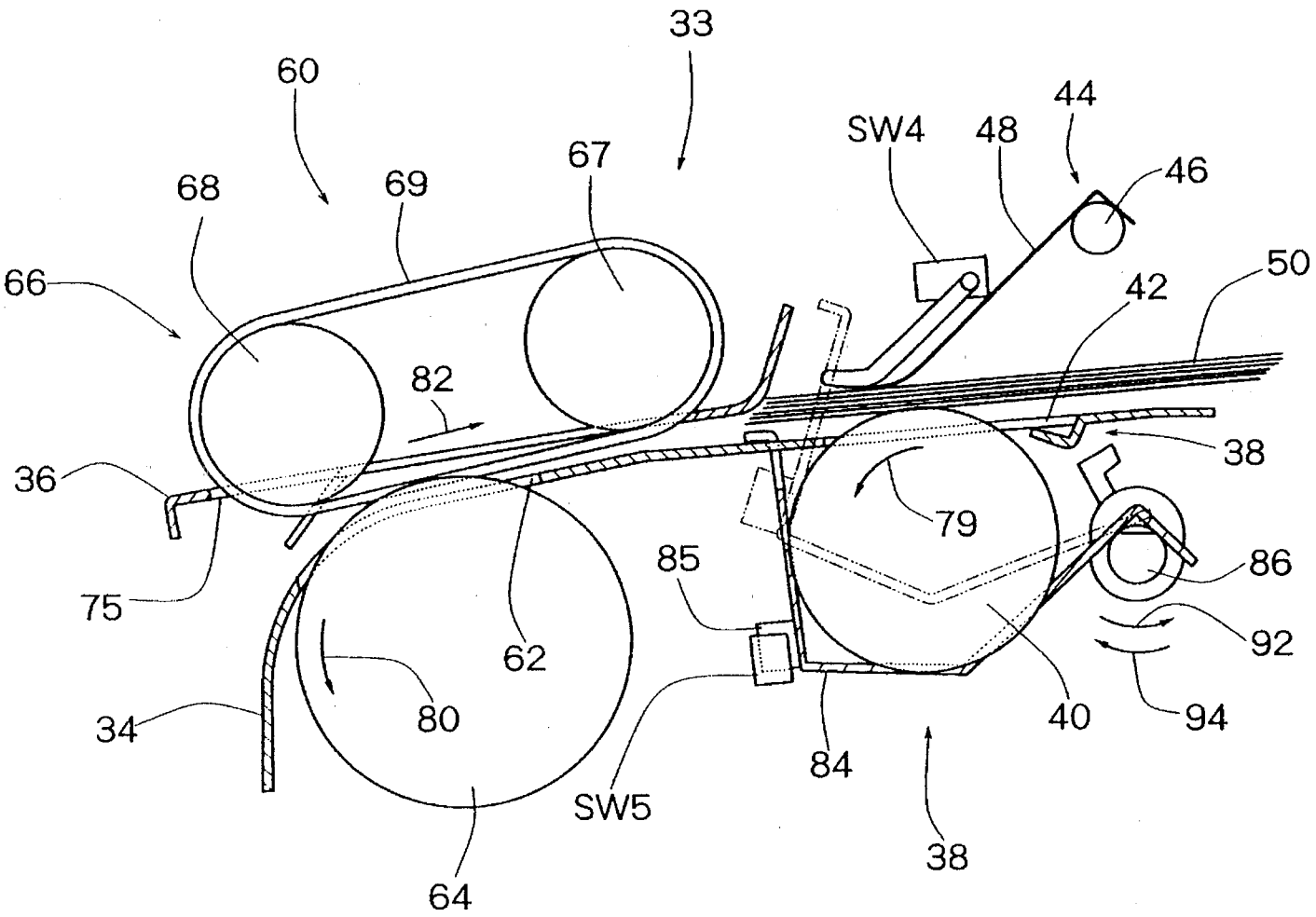
FIG. 3 is an enlarged sectional view of a sending-in means of the automatic document feeder shown in FIGS. 1 and 2.
Figure 4:
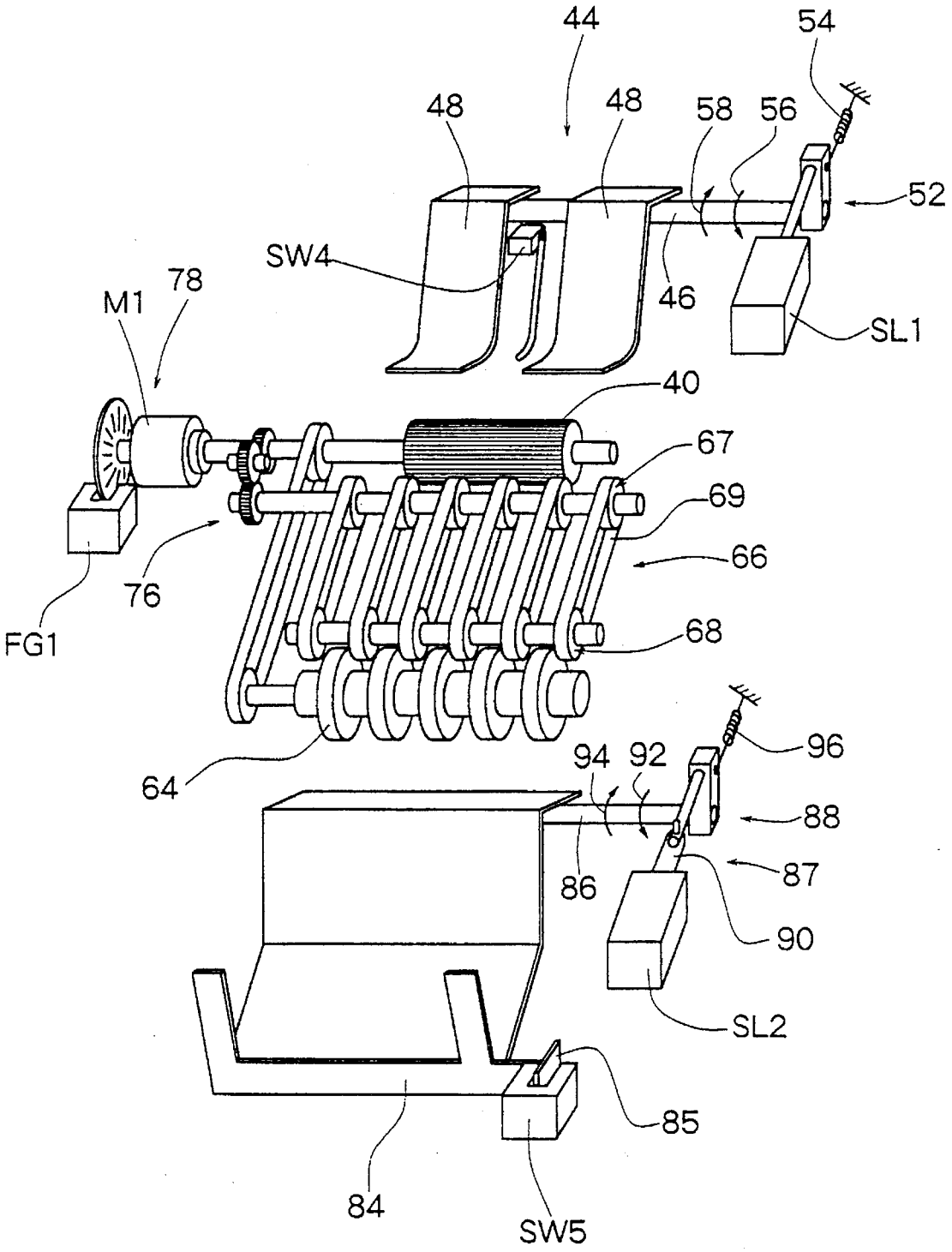
FIG. 4 is a developed perspective view of the sending-in means shown in FIG. 3.

Between the forwarding means 38 and the document separating means 60 is disposed a document stopper 84 constituted so as to be operable between an operating position where the documents 50 placed on the document bearing means 18 and inserted onto the stationary plate 34 are restrained from being advanced to the document separating means 60, and a retreat position where the movement of the document 50 into the document separating means 60 side is permitted, as illustrated in FIGS. 2 to 4. The document stopper 84 is disposed beneath the stationary plate 34, with its base end being fixed to a rotating shaft 86 disposed upstream of and spaced from the forwarding roller 40 and in parallel with the shaft of the forwarding roller 40. The forward end of document stopper 84 extends through an opening formed in the stationary plate 34. The rotating shaft 86 with the document stopper 84 attached is actuated by a stopper driving means 87. The stopper driving means 87 includes a latch type solenoid SL2 and a link mechanism 88 connecting a plunger 90 of the latch type solenoid SL2 with the rotating shaft 86. The latch type solenoid SL2 may be a well known one which has a permanent magnet, an attracting coil and a separating coil. When the attracting coil is energized, the plunger 90 is attracted. In this state, when the plunger 90 is attracted by the magnetism of the permanent magnet to move the plunger 90, and then the attracting coil deenergized, the plunger 90 remaining at the attracted position to which it moved. To separate the plunger 90 from the attracted state, the separating coil is energized to separate the plunger 90 by moving the plunger 90 against the magnetism of the permanent magnet, whereafter deenergizing of the separating coil results in the plunger 90 remaining at the separated position to which it moved. Thus, when the attracting coil of the latch type solenoid SL2 is energized to attract the plunger 90, the rotating shaft 86 is rotated in the direction of an arrow 92, and the document stopper 84 attached to the rotating shaft 86 is set at the retreat position shown by the solid line in FIG. 3. When the separating coil of the latch type solenoid SL2 is energized to separate the plunger 90, the rotating shaft 86 is rotated in the direction of an arrow 94, and the document stopper 84 attached to the rotating shaft 86 is set at the operating position shown by the two-dot chain line in FIG. 3, and held there by the force of a return spring 96. To the document stopper 84 is attached a shielding plate 85, and a stopper position detecting means SW5 is disposed at a position opposed to the retreat position of the document stopper 84 shown by the solid line. The stopper position detecting means SW5 has a light emitting element and a light receiving element, providing the later-described controlling means with an ON signal as the first signal when the document stopper 84 is placed at the operating position shown by the two-dot chain line, and an OFF signal as the second signal when the document stopper 84 is put at the retreat position shown by the solid line and the shielding plate 85 is positioned between the light emitting element and the light receiving element.

Figure 5:
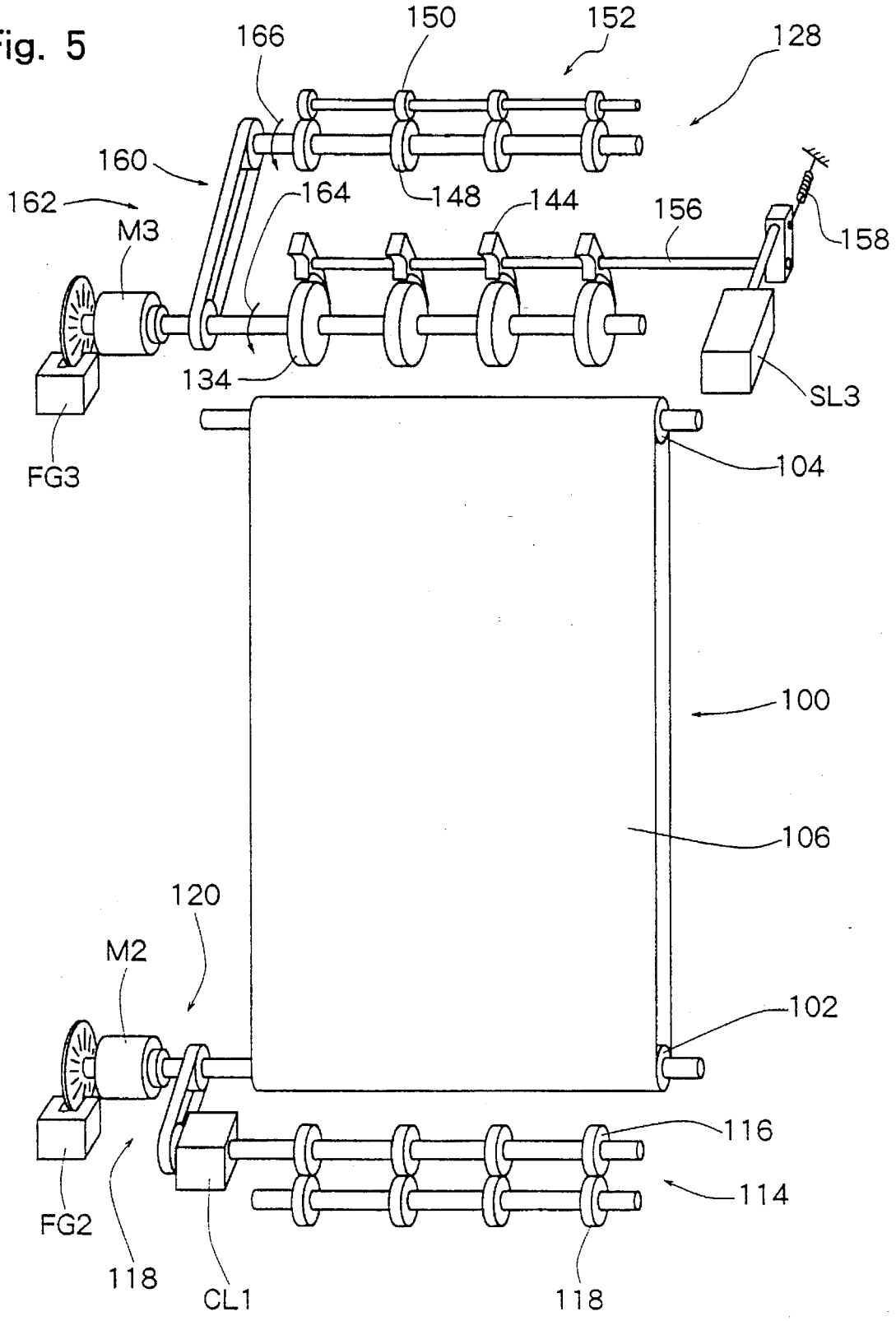
FIG. 5 is a developed perspective view of a conveying belt mechanism and a document reversing/discharging means of the automatic document feeder shown in FIGS. 1 and 2.

With reference to FIGS. 2 and 5, a conveying belt mechanism 100, constituting a document conveying means, is disposed below the document bearing means 18. The conveying belt mechanism 100 includes a driving roller 102 and a driven roller 104 disposed with spacing in the conveying direction (the left-to-right direction in FIG. 2), an endless belt 106 wound between these rollers, and rollers 105*a*, 105*b*, 105*c*, 105*d*, 105*e* for rolling which are disposed between the driving roller 102 and the driven roller 104. The lower traveling portion of the endless belt 106 is caused to extend along the transparent panel 8 of the electrostatic document copying machine 2, so that a document conveying path 108 is defined between the lower traveling portion and the transparent panel 8. Between such document conveying path 108 and the document separating means 60 is formed the document sending-in path 98. This document sending-in path 98 is defined between an internal guide plate 110 and an external guide plate 112. On the document sending-in path 98 is disposed a resist roller pair 114. The resist roller pair 114 consists of a driving roller 116 and a driven roller 118. On the document sending-in path 98 and upstream of the resist roller pair 114 is a reflector type optical document detector SW6 composed of a light emitting element and a light receiving element. The document detector SW6 detects the document 50 passing along the document sending-in path 98, and sends a detection signal to the controlling means to be described later. The driving roller 102 of the conveying belt mechanism 100 and the driving roller 116 of the resist roller pair 114 are rotationally driven by a driving means 120 comprised of an electric motor M2 capable of normal and reverse rotation, and a transmitting mechanism 118, such as a gear mechanism or a belt mechanism. The driving roller 116 of the resist roller pair 114 is connected to the transmitting mechanism 118 via an electromagnetic clutch CL1. To the electric motor M2 is mounted a rotational amount detecting means FG2, such as a rotary encoder or a frequency generator, which constitutes a means of detecting the amount of document conveyance. Pulse signals for indicating detection thereby are sent to the controlling means to be described later.

On the right side of the document conveying path 108 is disposed a document reversing/discharging means 128. The document reversing/discharging means 128 has a first document sending-out path 130, which is defined between a reversing roller 134 constituting a document reverse-conveying means and outside guide plates 136, 138. On the outer periphery of the reversing roller 134 are disposed three driven rollers 135*a*, 135*b*, 135*c* pressed against the reversing roller. Downstream of the first document sending-out path 130 are provided a second document sending-out path 140 and a document reversing path 142 in a bifurcated manner. At the bifurcated portion is disposed a bifurcation controlling plate 144. The second document sending-out path 140 is defined between the bifurcation controlling plate 144 and an outside guide plate 146. At the downstream end of the second document sending-out path 140 is disposed a discharge roller pair 152 consisting of a driving roller 148 and a driven roller 150. On the second document sending-out path 140 is disposed a reflector type optical document detector SW7 composed of a light emitting element and a light receiving element. The detector SW7 detects the document 50 passing along the second document sending-out path 140, and sends a detection signal to the controlling means to be described later. The reversing path 142 is defined between the reversing roller 134 and the bifurcation controlling plate 144 and an outside guide plate 154, with its downstream end facing the downstream end of the document conveying path 108. On the document reversing path 142 is disposed a reflector type optical document detector SW8 composed of a light emitting element and a light receiving element. The detector SW8 detects the document 50 passing along the document reversing path 142, and sends a detection signal to the controlling means to be described later. The bifurcation controlling plate 144 has a middle portion mounted on a shaft 156, and is adapted to be operated by a solenoid SL3 (FIG. 5). When the solenoid SL3 is deenergized, it is in a position indicated by a solid line in FIG. 2 owing to the spring force of a return spring 158. When the solenoid SL3 is energized, the plate 144 is moved to a position indicated by a two-dot chain line in FIG. 2 against the spring force of the return spring 158. Therefore, the document conveyed along the first document sending-out path 130 is sent to the second document sending-out path 140 when the solenoid SL3 is deenergized, but is sent to the document reversing path 142 when the solenoid SL3 is energized. The reversing roller 134 and the driving roller 148 of the discharge roller pair 152 are rotationally driven in directions shown by arrows 164 and 166, respectively, by a driving means 162 comprised of an electric motor M3 and a transmitting mechanism 160, such as a gear mechanism or an electric belt mechanism. To the electric motor M3 is mounted a rotational amount detecting means FG3, such as a rotary encoder or a frequency generator, which constitutes a means for detecting the amount of document conveyance. Pulse signals as signals for indicating detection thereby are sent to the controlling means to be described later.

Figure 6:
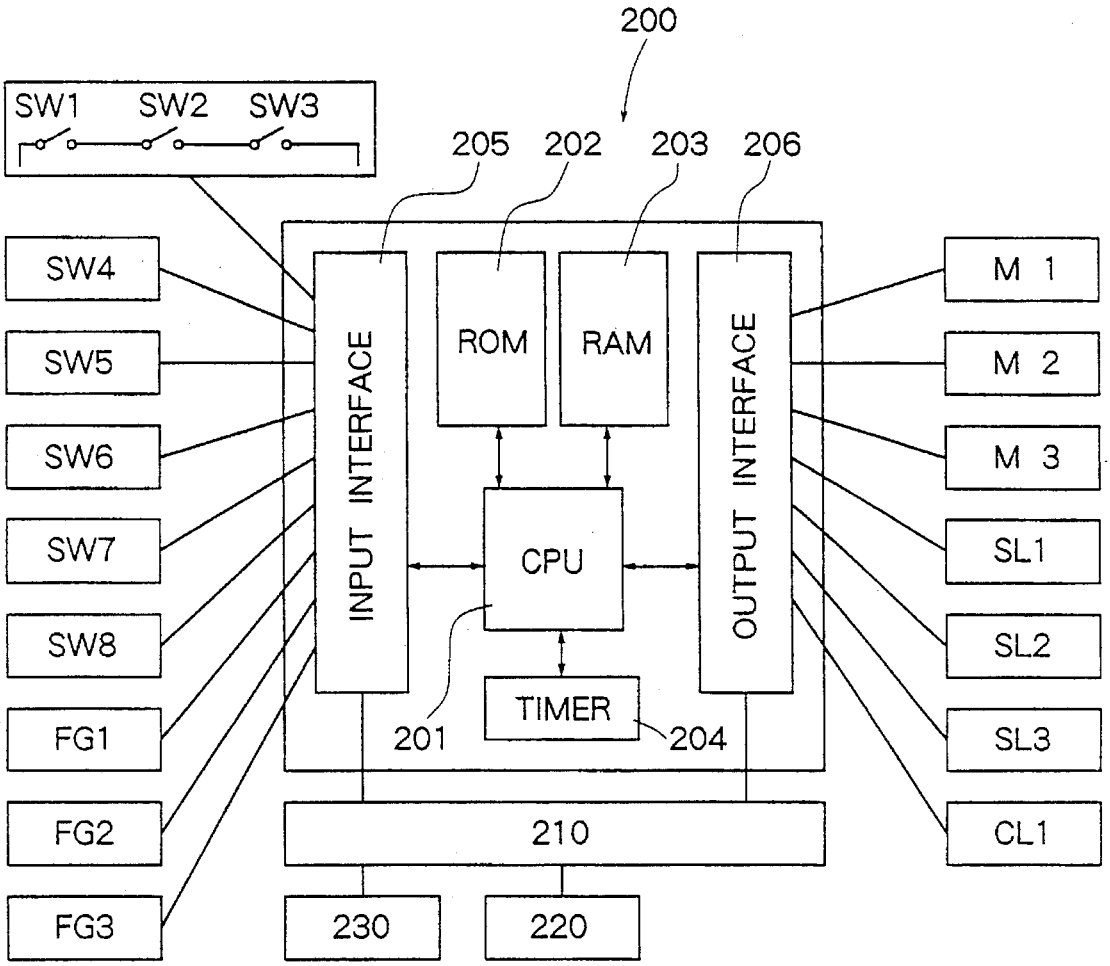
FIG. 6 is block diagram of a controlling means to be mounted on the automatic document feeder shown in FIGS. 1 and 2.

The automatic document feeder has a controlling means 200 shown in FIG. 6. The controlling means 200 is constituted by a microcomputer which has a central processing unit (CPU) 201 for performing operations according to a control program, a read-only memory (ROM) 202 for storing the control program and a control map, a random access memory (RAM) 203 for storing the results of operations and capable of reading and writing, a timer 204, an input interface 205, and an output interface 206. The input interface 205 of the so constituted controlling means 200 receives detection signals from the safety switches SW1, SW2, SW3, the document setting switch SW4, the stopper position detecting means SW5, the reflector type optical detectors SW6, SW7, SW8, and the rotational amount detecting means FG1, FG2, FG3, while the output interface 206 puts out control signals to the electric motors M1, M2, M3, the solenoids SL1, SL3, the latch type solenoid SL2, and the electromagnetic clutch CL1. The controlling means 200 is connected to a controlling means 210 for the electrostatic document copying machine 2, so that control signals are exchanged between both means. To the controlling means 210 for the electrostatic document copying machine 2 is connected an operating means 220 and a display means 230. As shown in FIG. 1, the operating means 220 is placed on the top of the front portion of the electrostatic document copying machine 2 and includes operating keys for copying actions, such as a key for starting copying, a key for designating the number of copies, a key for designating copying of both surfaces of the document, and a key for stopping copying. Through these keys, the operating means 220 enters copying information into the controlling means 210 for the electrostatic document copying machine 2. The display means 230 is disposed, similar to the operating means 220, on the top of the front portion of the electrostatic document copying machine 2 and adjacent to the operating means 220 to show information on copying, information on malfunctions, and so forth.

Figure 7:
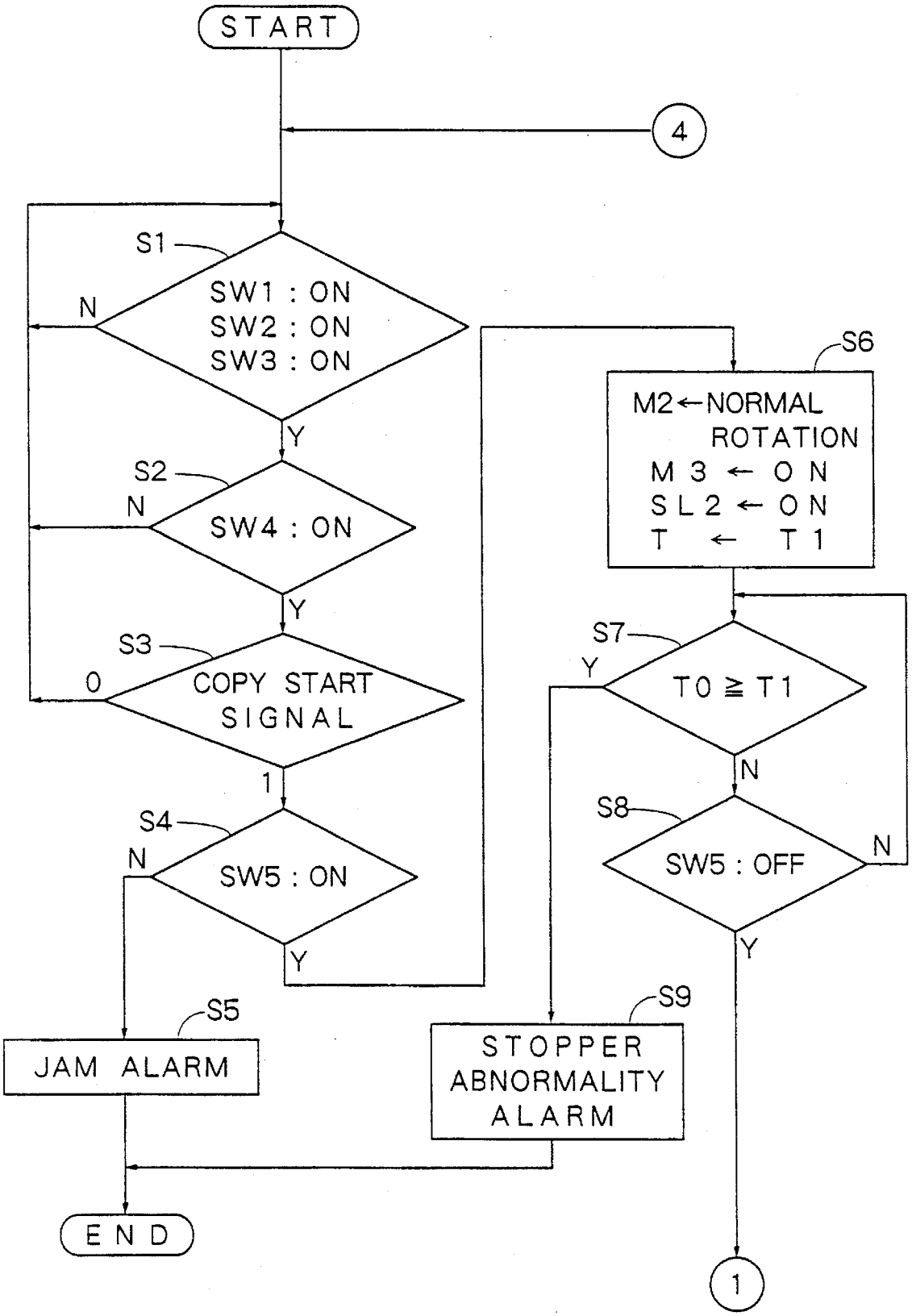
FIG. 7 is a flow chart showing part of a main routine representing the treating procedure by the controlling means shown in FIG. 6.
Figure 8:
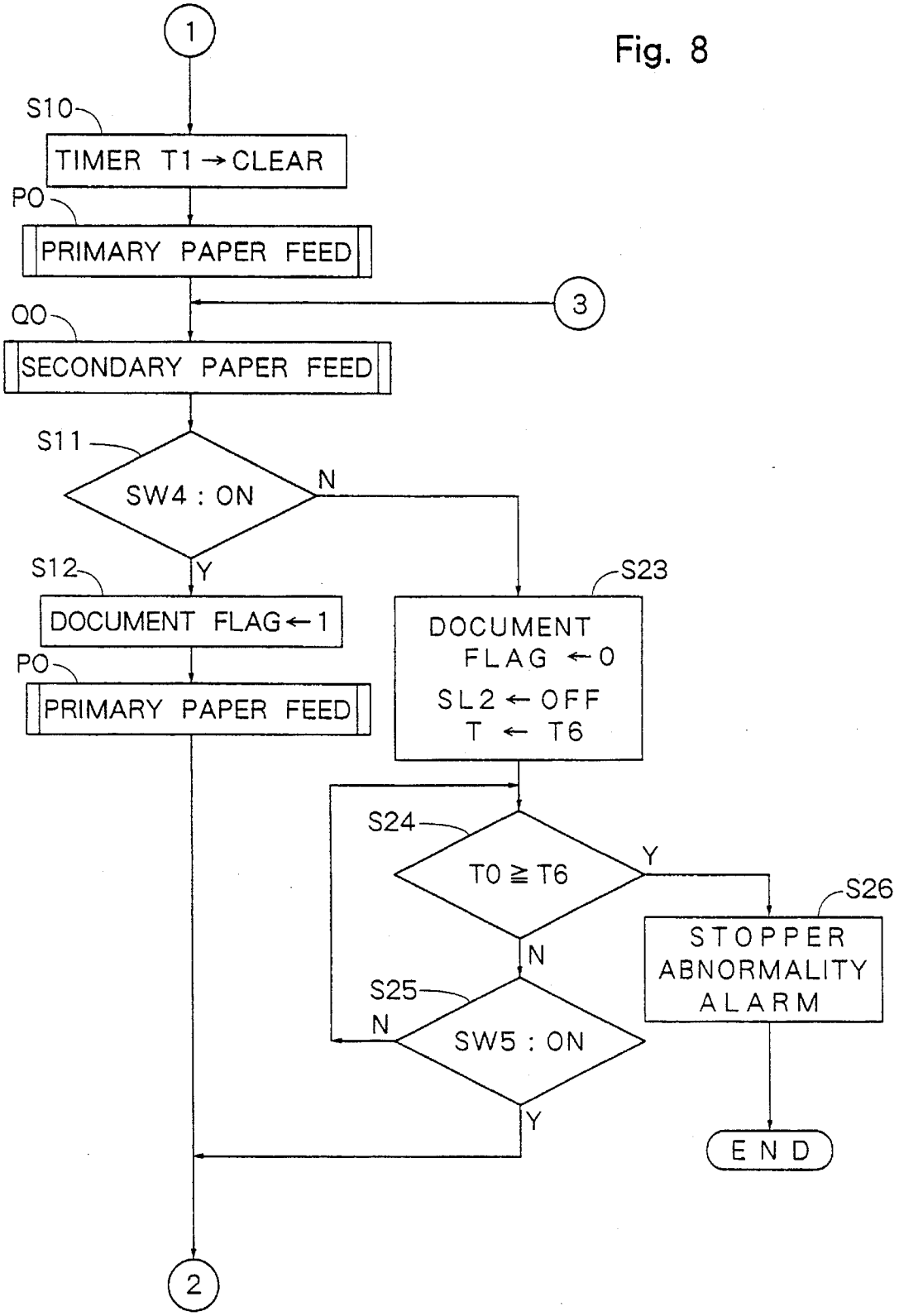
FIG. 8 is a flow chart showing another part of the main routine representing the treating procedure by the controlling means shown in FIG. 6.
Figure 9:
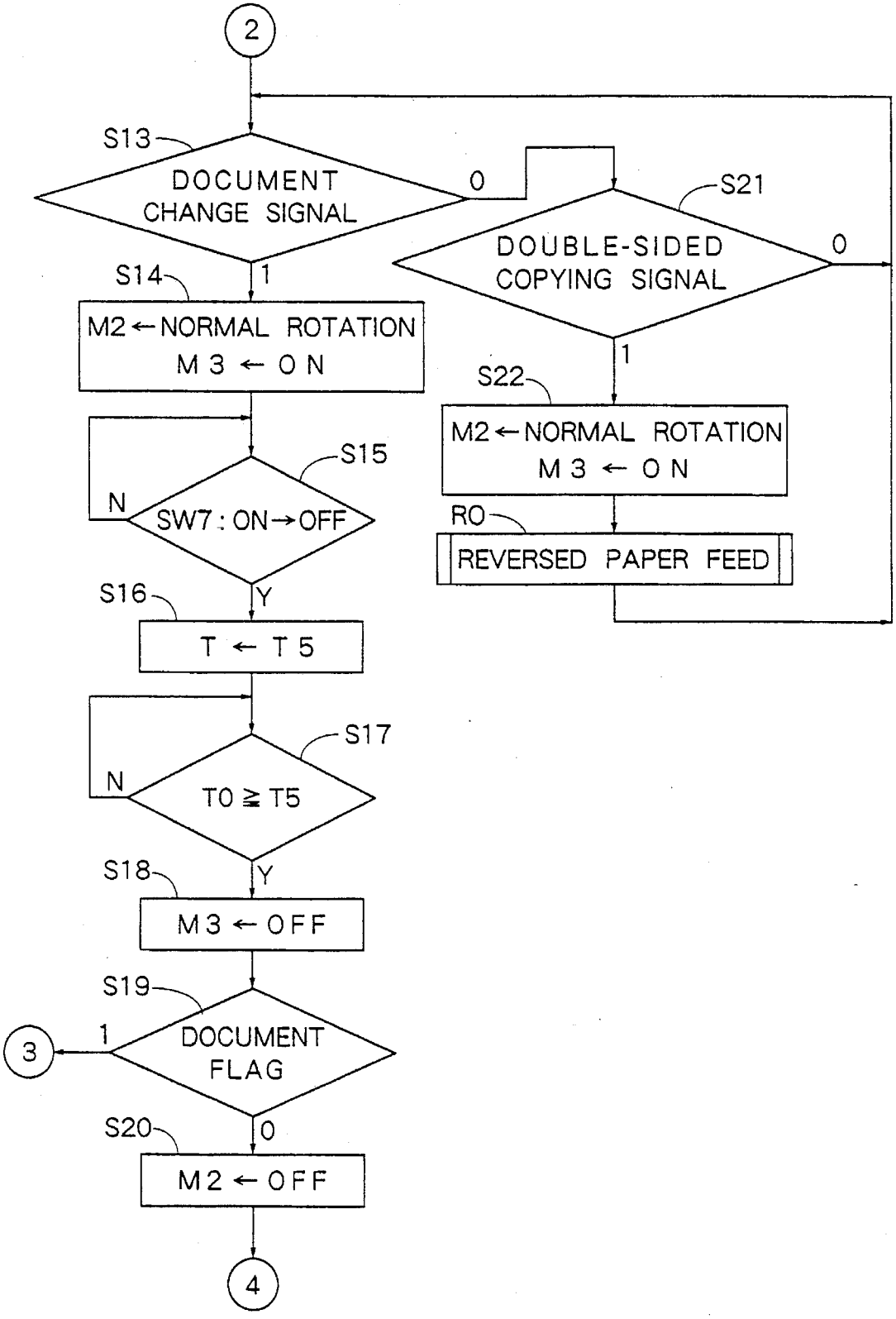
FIG. 9 is a flow chart showing another part of the main routine representing the treating procedure by the controlling means shown in FIG. 6.
Figure 10:
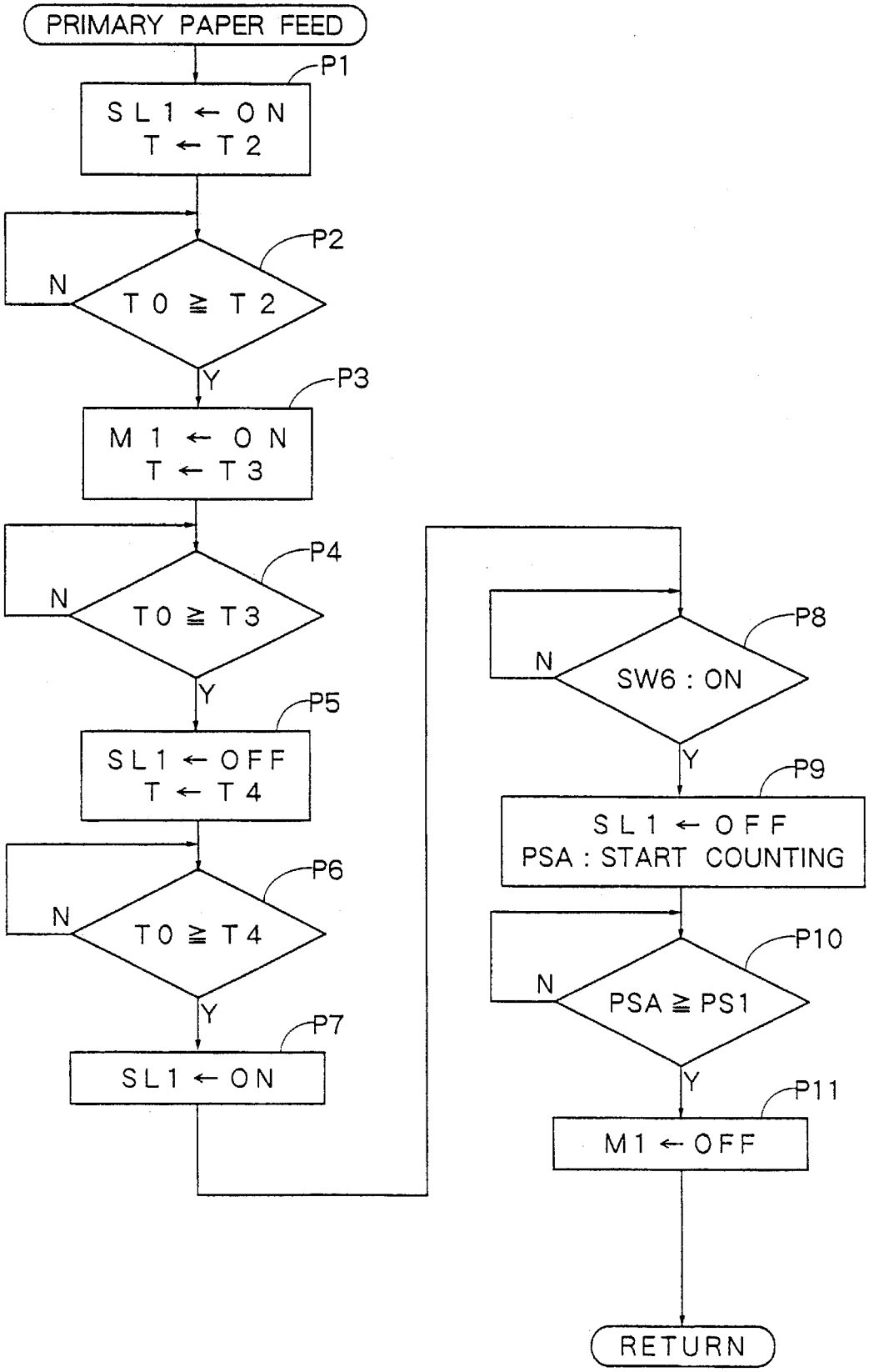
FIG. 10 is a flow chart showing a subroutine for primary paper feed, representing the treating procedure by the controlling means shown in FIG. 6.
Figure 11:
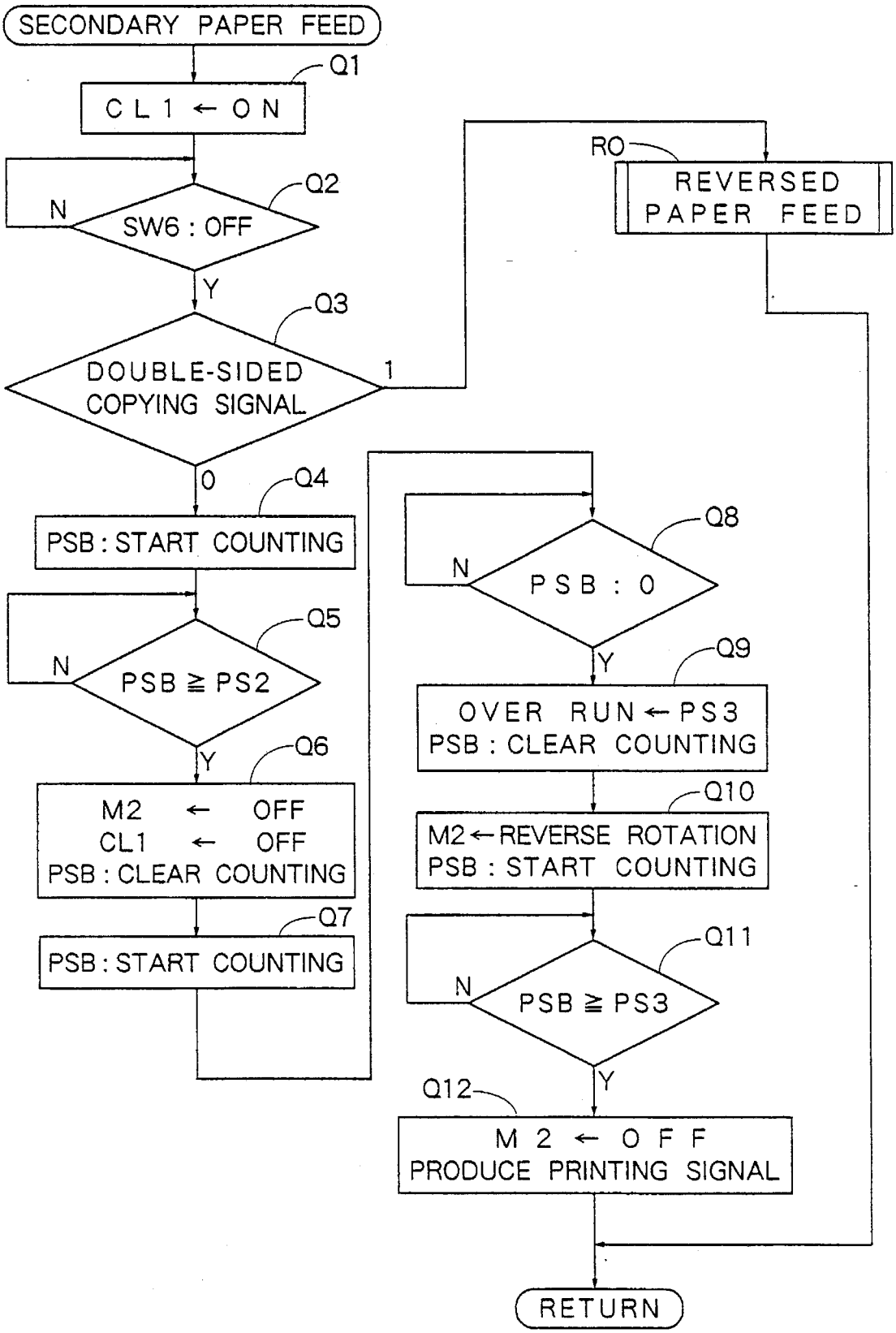
FIG. 11 is a flow chart showing a subroutine for secondary paper feed, representing the treating procedure by the controlling means shown in FIG. 6.
Figure 12:
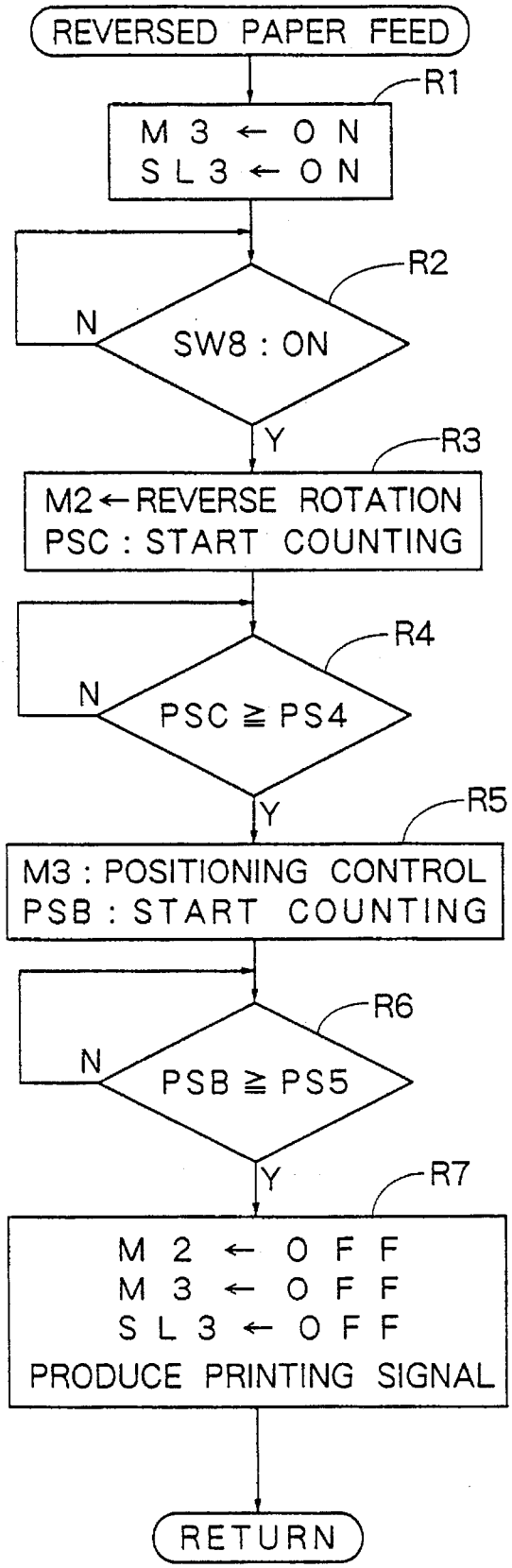
FIG. 12 is a flow chart showing a subroutine for reversed paper feed, representing the treating procedure by the controlling means shown in FIG. 6.

The automatic document feeder according to the illustrated embodiment is constituted as described above. The operating procedure for it will be described with reference to flow charts shown in FIGS. 7 to 12. FIGS. 7 to 9 show a main routine, FIG. 10 shows a subroutine for primary paper feed, FIG. 11 shows a subroutine for secondary paper feed, and FIG. 12 shows a subroutine for reversed paper feed.

In the main routine shown in FIGS. 7 to 9, the controlling means 200 checks at step S1 whether the safety switches SW1, SW2 and SW3 are all ON or not. That is, it will be dangerous if the automatic document feeder 4 is actuated while the feeder 4, the left end portion cover 30, or the right end portion cover 32 is open. This is a check for prohibiting the actuation of the automatic document feeder 4 if any one of them is open. Thus, if any one of the safety switches SW1, SW2 and SW3 is OFF at step S1, the device 4 is put on standby until the associated cover is brought to the closed position. With all switches ON, the procedure goes to step S2 to determine whether the document setting switch SW4 is ON, i.e., whether documents are placed on the document bearing means 18 or not. If the document setting switch SW4 is not ON, step S1 is resumed based on the judgment that no document has been placed on the document bearing means 18. When the document setting switch SW4 is ON at step S2, the procedure goes to step S3 based on judgment that one or more documents have been placed on the document bearing means 18. At this step, the controlling means 200 checks whether a copy start signal has been sent by the controlling means 210 of the electrostatic document copying machine 2. The copy start signal is sent by the controlling means 210 to the controlling means 200 when entered by the operator from the copy start key of the operating means 220. No receipt of the copy start signal means no need for copying, and results in the return to step 1. Upon receipt of the copy start signal at step S3, the controlling means 200 goes to step S4 to check whether the stopper position detecting means SW5 is ON or not, i.e., whether the document stopper 84 is in the operating position shown by the two-dot chain line in FIG. 3. If the documents 50 are placed on the document bearing means 18 and inserted onto the stationary plate 34 with the document stopper 84 not being situated at the operating position shown by the two-dot chain line in FIG. 3, all of the documents 50 may reach the document separating means 60, resulting in the possibility of two or more of the documents being advanced at the same time. To avoid this situation, step 4 is performed to check whether the document stopper 84 is in the operating position and whether the documents 50 have been set at a predetermined position of insertion. If the stopper position detecting means SW5 is not ON at step 4, the documents 50 are likely to reach the document separating means 60, resulting in the possibility for the simultaneous delivery of two or more of the documents. Thus, the controlling means 200 does not move to the document sending-in action, but goes to step S5, initiating a jam alarm on the display means 230 via the controlling means 210 of the electrostatic document copying machine 2. This prevents the simultaneous delivery of two or more of the documents, which may occur if the documents 50 are placed on the document bearing means 18 and inserted onto the stationary plate 34 with the document stopper 84 not being situated at the operating position.

If the stopper position detecting means SW5 is ON at step S4, i.e., the document stopper 84 is situated at the operating position, the controlling means 200 proceeds to step 6. At this step, the controlling means 200 drives the electric motor M2 in a normal rotational manner to actuate the conveying belt mechanism 100, and drives the electric motor M3 to actuate the reversing roller 134 and the discharge roller 148, and in addition, acts to discharge the document left placed on the transparent panel 8, if any. The controlling means 200 also turns on the latch type solenoid SL2 at step S6 (the latch type solenoid energizes the attracting coil if it is to pull the plunger, and energizes the separating coil if it is to separate the plunger; for convenience's sake, the attraction of the plunger is designated as ON, and the separation of the plunger as OFF, in the description that will follow). That is, the plunger of the latch type solenoid SL2 is attracted to bring the document stopper 84 to the retreat position shown by the solid line in FIG. 3. In addition to so actuating the electric motors M2 and M3 and the latch type solenoid SL2, the controlling means 200 sets the timer T at T1. This set time, T1, has been set to, for example, 100 msec. Then, the controlling means 200 checks whether the time, T0, that elapses after the setting of the timer T to T1 has reached the set time T1 (step 7). If the elapsing time T0 has not reached the set time T1, the controlling means 200 goes to step S8 to see whether the stopper position detecting means SW5 is OFF or not, i.e., whether the document stopper 84 is at the retreat position shown by the solid line in FIG. 3. If the stopper position detecting means SW5 is not OFF at step S8, step S7 is resumed to make checks until the elapsing time T0 reaches the set time T1. If the stopper position detecting means SW5 does not become OFF even after the lapse of the set time T1, the controlling means 200 prohibits the action of the document sending-in means 33, moving to step S9. There, the controlling means 200 shows the abnormality of the document stopper 84 on the display means 230 via the controlling means 210 of the electrostatic document copying machine 2. From this display of abnormality, the operator can be aware that the latch type solenoid SL2 or the link mechanism 88 constituting the stopper driving means 87 is out of order. If the stopper position detecting means SW5 is OFF, the controlling means 200 goes to step S10 shown in FIG. 8, and clears the timer. It further proceeds to step P0 to perform a subroutine for primary paper feed.

Next, the subroutine for primary paper feed shown in FIG. 10 will be described. The controlling means 200 energizes the solenoid SL1 at step P1 to actuate the pressing plate 48 and make the pressing plate press the top of the uppermost document of the documents 50 placed on the document bearing means 18 and inserted onto the stationary plate 34. In addition, the controlling means 200 sets the timer T to T2. The set time T2 is the time required from the issue of the energizing signal by the controlling means 200 to the solenoid SL1 until the placement of the pressing plate 48 on the document bearing means 18 and its pressing of the top of the uppermost document. The set time T2 has been set, for example, at 100 msec. After setting the timer T to T2, the controlling means 200 goes to step P2, and checks whether the time, T0, that elapses after the setting of the timer T to T2, has reached the set time T2. If the elapsing time T0 has not reached the set time T2, the controlling means 200 is placed on standby. If the elapsing time T0 has reached the set time T2, the controlling means 200 proceeds to step P3 based on the judgment that the documents 50 have been placed on the document bearing means 18 and reliably pressed by the pressing plate 48. At this step, it drives the electric motor M1. Driving of the electric motor M1 results in the rotational driving of the forwarding roller 40, the paper feed roller 64, constituting the document separating means 60 together with the separating belt mechanism 66, and the driving roller 68 of the separating belt mechanism 66. Thus, the lowermost document in the document layer placed on the document bearing means 18 and inserted onto the stationary plate 34 is fed to the document sending-in path 98. Simultaneously with driving the electric motor M1 to start the conveyance of the documents 50 placed on the document bearing means 18, the controlling means 200 sets the timer T to T3. The set time T3 is the time required from the start of the conveyance of the document 50 until the passage of the front end of the document through the nip portion between the paper feed roller 64 and the separating belt mechanism 66. The set time T3 has been set, for example, at 160 msec. After setting the timer T to T3, the controlling means 200 goes to step P4 and checks whether the time, T0, that elapses after the setting of the timer T to T3 has reached the set time T3. If the elapsing time T0 has not reached the set time T3, the controlling means 200 is placed on standby. If the elapsing time T0 has reached the set time T3, the controlling means 200 proceeds to step P5 to deenergize the solenoid SL1. Upon deenergizing of the solenoid SL1, the pressure on the documents 50 laid on the document bearing means 18 is released. Hence, in the case of a deflection occurring in the second or later document owing to its friction with the first document being conveyed, this friction is removed, so that the second or later document returns to its original shape owing to its elasticity before getting wrinkled. When the solenoid SL1 is deenergized and the pressure on the documents 50 by the pressing plate 48 is released, the conveying power of the forwarding roller 40 is eliminated. In this state, the document is carried only by the paper feed roller 64. Simultaneously with deenergizing the solenoid SL1 to release the pressure on the documents 50 by the pressing plate 48, the controlling means 200 sets the timer T to T4. The set time T4 is the time required for the second or later document, deflected by its friction with the first document being conveyed, to return to its original shape because the pressure by the pressing plate 48 is released. The set time T4 has been set, for example, at 200 msec. After setting the timer T to T4, the controlling means 200 goes to step P6, and checks whether the time, T0, that elapses after the setting of the timer T to T4 has reached the set time T4. If the elapsing time T0 has not reached the set time T4, the controlling means 200 is placed on standby. If the elapsing time T0 has reached the set time T4, the controlling means 200 proceeds to step P7 to energize the solenoid SL1 again. Upon energizing of the solenoid SL1, the pressure on the documents 50 by the pressing plate 48 appears, thereby restoring the conveying power of the forwarding roller 40. Thus, the document is conveyed by the conveying power of the forwarding roller 40 and the paper feed roller 64. After energizing the solenoid SL1 again, the controlling means 200 moves on to step P8, checking whether the detector SW6 is ON or not, i.e., whether the front end of the document fed to the document sending-in path 98 has reached the detector SW6 or not. If the detector SW6 is not ON at step P8, the controlling means 200 is placed on standby. If the detector SW6 is ON, the controlling means 200 goes to step P9 to deenergize the solenoid SL1, thereby releasing the pressure on the documents 50 by the pressing plate 48. At the same time, the controlling means 200 starts counting of pulse signals, PSA, from the rotational amount detecting means FG1 mounted on the electric motor M1. After starting the counting of the pulse signals PSA at step P9, the controlling means 200 goes to step P10 to check whether the pulse signals PSA have reached the set number of pulses, PS1. The set number of pulses PS1 corresponds to the amount of rotation of the electric motor M1 corresponding to the amount of conveyance of the document from the time that its front end passes the detector SW6 until its contact with the nip portion of the resist roller pair 114 for its further slight bending. If the pulse signals PSA have not reached the set pulse number PS1 at step P10, the controlling means 200 is placed on standby to continue document conveyance. If the pulse signals PSA have reached the set pulse number PS1, a judgment is made that the front end of the document has been brought into contact with the nip portion of the resist roller pair 114. Based on this judgment, the electric motor M1 is put in the OFF state to stop the paper feeding action for the document. As a result of this primary paper feed, the document fed to the document sending-in path 98 by the forwarding roller 40 and the document separating means 60 has its front end in contact with the nip portion of the resist roller pair 114 which is in the non-operating state. Thus, the primary paper feed comes to an end.

After the primary paper feed has been completed as described above, the main routine shown in FIG. 8 is resumed. The controlling means 200 goes to step Q0 to perform secondary paper feed. The subroutine for the secondary paper feed will be described with reference to FIG. 11. The controlling means 200 energizes the electromagnetic clutch CL1 mounted on the driving roller 116 of the resist roller pair 114 at step Q1. Once the electromagnetic clutch CL1 is energized, the electric motor M2 that has already been driven in the normal direction of rotation drives the driving roller 116 of the resist roller pair 114 rotationally. Hence, the document that has been fed to the nip portion of the resist roller pair 114 by the primary paper feed is carried toward the document conveying path 108 extending along the transparent panel 8 of the electrostatic document copying machine 2. Further, it is conveyed on the transparent panel 8 from the left-hand side (one end portion) toward the right-hand side (the other end portion) in FIG. 2 by the conveying belt mechanism 100 constituting the conveying means. Then, the controlling means 200 checks at step Q2 whether the detector SW6 disposed along the document sending-in path 98 is OFF or not, i.e., whether the rear end of the document has passed the detector SW6 or not. If the detector SW6 is not OFF, the controlling means 200 is put on standby. If the detector SW6 is OFF, the controlling means 200 moves on to step Q3 based on the judgment that the rear end of the document has passed the detector SW6. This step is intended to determine whether a double-sided copying signal has been received from the controlling means 210 of the electrostatic document copying machine 2 or not. This double-sided copying signal is entered by the operator into the controlling means 210 of the electrostatic document copying machine 2 using the double-sided copying designation key of the operating means 220. Based on this input, the double-sided copying signal is sent from the controlling means 210 to the controlling means 200. In the presence of the double-sided copying signal at step Q3, the controlling means 200 proceeds to step R0 to perform a subroutine for reversed paper feed. The subroutine for reversed paper feed will be described later. In the absence of the double-sided copying signal at step Q3, the controlling means 200 proceeds to step Q4 to start counting of pulse signals, PSB, from the rotational amount detecting means FG2 mounted on the electric motor M2 of the conveying belt mechanism 100. After starting the counting of the pulse signals PSB at step Q4, the controlling means 200 goes to step Q5 to check whether the pulse signals PSB have reached the set number of pulses, PS2. The set number of pulses PS2 corresponds to the amount of rotation of the electric motor M2 corresponding to the amount of conveyance of the document from the site of the detector SW6 to the document setting standard position G in FIG. 2. If the pulse signals PSB have not reached the set pulse number PS2 at step Q5, the controlling means 200 is placed on standby to continue document conveyance. If the pulse signals PSB have reached the set pulse number PS2, a judgment is made that the rear end of the document has arrived at the document setting standard position G. Based on this judgment, the controlling means 200 moves on to step Q6 to switch off the electric motor M2, thereby stopping the action of the conveying belt mechanism 100. Simultaneously, the electromagnetic clutch CL1 is turned off, and the counting of the pulse signals PSB from the rotational amount detecting means FG2 is cleared. Then, the controlling means 200 starts counting of pulse signals PSB from the rotational amount detecting means FG2 again at step Q7. This is because the driving shaft of the electric motor M2 that has been switched off does not stop immediately, but slightly rotates by inertial force. In correspondence with the amount of rotation due to this inertial force, the rear end of the document overruns beyond the document setting standard position G to a position on the right side of the document setting standard position G in FIG. 2, and stops there. The recounting action is intended to detect this surplus conveyance (overrun). After starting the recounting of pulse signals PSB from the rotational amount detecting means FG2 at step Q7, the controlling means 200 checks whether the pulse signals PSB incoming from the rotational amount detecting means FG2 have stopped or not, i.e., whether the electric motor M2 has come to a halt without fail (step Q8). After making sure that the number of pulse signals PSB from the rotational amount detecting means FG2 has become zero at step Q8, the controlling means 200 goes to step Q9. At this step, the controlling means 200 stores the number of pulses PS3 from the rotational amount detecting means FG2, obtained up to the time when the electric motor M2 has come to a halt without fail, i.e., the pulse signals PSB from the rotational amount detecting means FG2 have stopped, as the overrun in the random access memory (RAM) 203, and also clears the counting of the pulse signals PSB from the rotational amount detecting means FG2. Then, at step Q10, the controlling means 200 drives the electric motor M2 reversely to actuate the conveying belt mechanism 100 reversely, and also starts counting pulse signals PSB from the rotational amount detecting means FG2 mounted on the electric motor M2. After starting the counting of the pulse signals PSB from the rotational amount detecting means FG2 at step Q10, the controlling means 200 goes to step Q11 to check whether the pulse signals PSB have reached the pulse number PS3 corresponding to the overrun. If the pulse signals PSB have not reached the pulse number PS3 corresponding to the overrun at step Q11, the controlling means 200 is placed on standby to continue reverse document conveyance. If the pulse signals PSB have reached the pulse number PS3 corresponding to the overrun, a judgment is made that the rear end of the document has arrived at the document setting standard position G. Based on this judgment, the controlling means 200 moves on to step Q12 to switch off the electric motor M2, thereby stopping the action of the conveying belt mechanism 100. The controlling means 200 also puts out a printing signal, i.e., an exposure ready signal, to the controlling means 210 of the electrostatic document copying machine 2.

Next, a reversed paper feed action will be described based on a reversed paper feed subroutine shown in FIG. 12. At step R1, the controlling means 200 switches on the electric motor M3 to rotationally drive the reversing roller 134, and also turns on and energizes the solenoid SL3 which operates and controls the bifurcation controlling plate 144. Once the solenoid SL3 is energized, the bifurcation controlling plate 144 is brought to the position shown by the two-dot chain line in FIG. 2. Thus, the document to be conveyed by the conveying belt mechanism 100 and the reversing roller 134 is conveyed through the document conveying path 108 formed on the transparent panel 8 from the left-hand side (one end portion) to the right-hand side (the other end portion) in FIG. 2, and sent through the first document sending-out path 130 toward the document reversing path 142. After actuating the electric motor M3 and the solenoid SL3 to carry the document to the document reversing path 142 in this manner, the controlling means 200 checks whether the document detector SW8 disposed along the reversing path 142 is ON or not, i.e., whether the front end of the document has reached the document detector SW8 or not (step R2). If the document detector SW8 is not ON, the controlling means 200 is placed on standby. If the detector SW8 is ON, the controlling means 200 goes to step R3 to reversely drive the electric motor M2 of the conveying belt mechanism 100, thereby reversely actuating the conveying belt mechanism 100. At the same time, the controlling means 200 starts counting of pulse signals, PSC, from the rotational amount detecting means FG3 mounted on the electric motor M3 which drives the reversing roller 134. After starting the counting of the pulse signals PSC from the rotational amount detecting means FG3 at step R3, the controlling means 200 goes to step R4 to check whether the pulse signals PSC have reached the set number of pulses, PS4 (the first predetermined amount of conveyance). The set pulse number PS4 has been set at the amount of document conveyance (pulse number) by the reversing roller 134 corresponding to the time from the start of reverse driving of the electric motor M2 of the conveying belt mechanism 100 until stabilization of its rotational speed. The document thus conveyed by the reversing roller 134 is introduced to the right side (the other end portion) of the document conveying path 108 in FIG. 2, and conveyed toward the left-hand side (one end portion) by the conveying belt mechanism 100. If the pulse signals PSC have not reached the set pulse number PS4 at step R4, the controlling means 200 is placed on standby. If the pulse signals PSC have reached the set pulse number PS4, the controlling means 200 proceeds to step R5 to start the positioning control of the electric motor M2 of the conveying belt mechanism 100. Simultaneously, the controlling means 200 starts counting of pulse signals, PSB, from the rotational amount detecting means FG2 mounted on the electric motor M2. The positioning control means control by which when the front end of the document conveyed by the conveying belt mechanism approaches the document setting standard position G in FIG. 2, the rotational speed of the electric motor M2 is decreased, and when the pulse signals PSB have reached the set pulse number PS5 (the second predetermined amount of conveyance) and the electric motor M2 is turned off, it stops without fail so that the document will not overrun past the document setting standard position G owing to inertial force. After starting the counting of the pulse signals PSB, the controlling means 200 goes to step R6 to check whether the pulse signals PSB have reached the set number of pulses, PS5 (the second predetermined amount of conveyance). The set pulse number PS5 is a pulse number corresponding to the amount of conveyance of the document by which the front end of the document that has been sent to the conveying belt mechanism 100 at the start of counting the pulse signals PSB is conveyed to the document setting standard position G by the conveying belt mechanism 100. If the pulse signals PSB have not reached the set pulse number PS5 at step R6, the controlling means 200 is placed on standby to continue document conveyance. If the pulse signals PSB have reached the set pulse number PS5, a judgment is made that the front end of the document has arrived at the document setting standard position G. Based on this judgment, the controlling means 200 moves on to step R7 to switch off the electric motor M2, thereby stopping the action of the conveying belt mechanism 100. Simultaneously, it switches off the electric motor M3 to stop the operation of the reversing roller 134 and the discharge roller 148. Further, it turns off and deenergizes the solenoid SL3 to bring the bifurcation controlling plate 144 to the position shown by the solid line in FIG. 2. The controlling means 200 also puts out a printing signal, i.e., an exposure ready signal, to the controlling means 210 of the electrostatic document copying machine 2.

Next, the main flow of FIG. 8 will be resumed again. After performing the primary paper feed subroutine P0, secondary paper feed subroutine Q0, and if appropriate, the reversed paper feed subroutine R0 as described above, the controlling means 200 checks at step S11 whether the document setting switch SW4 is ON or not, i.e., whether a document is on the document bearing means 18 or not. If the document setting switch SW4 is ON, the controlling means 200 sets a document flag (step S12) and performs the primary paper feed subroutine P0 again. The primary paper feed subroutine P0 is carried out during the exposure of the preceding document conveyed on the transparent panel 8. After performing the primary paper feed subroutine P0 again, the controlling means 200 proceeds to step S13 as shown in FIG. 9 to make sure that a document change signal has been received from the controlling means 210 of the electrostatic document copying machine 2. This document change signal is sent by the controlling means 210 of the electrostatic document copying machine 2 to the controlling means 200 when the exposure of the preceding document conveyed on the transparent panel 8 is completed. In the presence of the document change signal at step S13, the controlling means 200 goes to step S14, where it drives the electric motor M2 in the normal direction of rotation to drive the conveying belt mechanism 100, and also drives the electric motor M3 to rotationally drive the reversing roller 134 and the discharge roller 148, thereby performing a discharge action for the document on the transparent panel 8 that has completed exposure. By this discharge action, the document on the transparent panel 8 that has completed exposure is conveyed on the transparent panel 8 rightward in FIG. 2, and further carried to the second document sending-out path 140 by way of the first document sending-out path 130. After starting the document discharge action by driving the electric motors M2 and M3, the controlling means 200 moves on to step S15 to check whether the document detector SW7, disposed along the second document sending-out path 140, has become OFF after becoming ON, i.e., whether the rear end of the document conveyed to the second document sending-out path 140 has passed the detector SW7. If the detector SW7 has not become OFF after becoming ON, the controlling means 200 is placed on standby. If the detector SW7 has become OFF after becoming ON, a judgment is made that the rear end of the document has passed the document detector SW7. Based on this judgment, the controlling means 200 proceeds to step S16 to set the timer T to T5. This set time T5 is the time from the passage of the rear end of the document beyond the document detector SW7 until its passage through the discharge roller 148. The time T5 has been set, for example, at 100 msec. After setting the timer T to T5 at step S16, the controlling means 200 goes to step S17 to see whether the time T0, elapsing after the rear end of the document passes the document detector SW7, has reached the set time T5 or not. In case the elapsing time T0 is less than the set time T5, the document discharge action is continued. When the elapsing time T0 is not less than the set time T5, a judgment is made that the rear end of the document has passed the discharge roller 148. Based on this judgment, the controlling means 200 goes to step S18, where it turns off the electric motor M3 to stop the operation of the reversing roller 134 and the discharge roller 148. The exposed document thus discharged from the discharge roller 148 is placed on the document discharge tray 20. Then, the controlling means 200 proceeds to step S19, where it checks whether the document flag has been set or not. In case the document flag has been set, it judges the next document to have completed primary paper feed, and moves on to the secondary paper feed subroutine Q0. If no document flag has been set at step S19, the controlling means 200 proceeds to step S20. At this step, judging that there is no document subjected to primary paper feed, the controlling means 200 switches off the electric motor M2 to terminate the action of the conveying belt mechanism 100. Subsequently, the controlling means 200 returns to step S1 to perform the aforementioned respective steps. In the absence of a document change signal at step S13, the controlling means 200 proceeds to step S21 to check whether a double-sided copying signal has been received or not. In case no double-sided copying signal has been received, it returns to step S13. If a double-sided copying signal has been received, it proceeds to step S22 to drive the electric motor M2 of the conveying belt mechanism 100 in the normal direction of rotation, and switch on the electric motor M3 which drives the reversing roller 134. This step is followed by the reversed paper feed subroutine R0.

If the document setting switch SW4 is not ON at the step S11 of FIG. 8, the controlling means 200 proceeds to step S23 based on the judgment that no document to be copied is on the document bearing means 18. At this step, the document flag is cleared, and the latch type solenoid SL2 is switched off to actuate the plunger in the direction of separation, thereby bringing the document stopper 84 to the operating position shown by the two-dot chain line in FIG. 3. Simultaneously, the controlling means 200 sets the timer T to T6 to check for trouble at the latch type solenoid SL2 and the link mechanism 88 that constitute the stopper driving means 87. The set time T6 has been set at, say, 100 msec. Then, the controlling means 200 checks whether the time T0 elapsing after the setting of the timer T to T6 has reached the set time T6 (step S24). If the elapsing time T0 is less than the set time T6, it goes to step S25 to see whether the stopper position detecting means SW5 is ON or not, i.e., whether the document stopper 84 is in the operating position shown by the two-dot chain line in FIG. 3 or not. If the stopper position detecting means SW5 is not ON at step S25, the controlling means returns to step S24, where it continues checking until the elapsing time T0 reaches the set time T6. If the stopper position detecting means SW5 does not become ON even after the passage of the set time T6, the controlling means proceeds to step S26 to show on the display means 230 that the document stopper 84 is out of order. From this malfunction display, the operator can know that the latch type solenoid SL2 or the link mechanism 88 constituting the stopper driving means 87 is in trouble.

While the present invention has been described hereinabove with reference to the illustrated embodiments, it is to be understood that the invention is in no way limited to these embodiments, and various changes and modifications are possible without departing from the scope of the invention. For instance, the illustrated embodiments show examples in which the timing of deenergizing and energizing the pressing mechanism is set by means of the timer provided in the controlling means. However, this timing may be set based on a detection signal from a detector disposed to detect the amount of rotation of the forwarding roller of the forwarding means. Alternatively, it may be set based on a detection signal from a detector disposed to detect the position of the document being conveyed. These manners are not excluded from the technical scope of the present invention.

The document separating mechanism of the automatic document feeder according to the present invention is constituted as described above. In response to a copy start signal, the controlling means energizes the pressing mechanism of the forwarding means, actuates the forwarding roller, and actuates the document separating means to carry the document laid on the document bearing means. During the carriage of the document to bring its front end to the resist roller pair, the controlling means deenergizes the pressing mechanism of the forwarding means at least once for a predetermined time during a period from the arrival of the front end of the document at the document separating means until its arrival at the resist roller pair, thereby releasing the pressure on the documents laid on the document bearing means. Hence, in case a deflection occurs in the second or later document owing to its friction with the first document being carried, this friction is removed, so that the second or later document returns to its original shape owing to its elasticity before getting wrinkled. Thus, even when a thin document with low resistance is used, the generation of wrinkles on the document during steps other than carriage can be prevented, and a document jam associated with the wrinkles developing on the document can also be prevented. In accordance with the present invention, moreover, the pressure on a plurality of documents piled up on the document bearing means is released with predetermined timing. Accordingly, compared with conventional devices in which the pressure is always imposed on the documents, the present invention lessens warpage of the documents relative to each other, reducing dirt on the back of the documents.

What we claim is:

1. An automatic document feeder for a document processor having a transparent panel for placement thereon of a document to be processed, said automatic document feeder comprising:

document bearing means for bearing documents to be processed;

forwarding means, including a forwarding roller, for forwardly delivering documents borne on said document bearing means, and a pressing mechanism for pressing the documents at the time of document delivery by said forwarding roller;

document separating means, including a paper feed roller disposed downstream of said forwarding means and adapted to be rotated in the direction of conveyance, and a separating mechanism disposed opposite said paper feed roller and adapted to be operated in a direction opposite said direction of conveyance;

a resist roller pair disposed downstream of said document separating means for temporarily stopping a document carried by said paper feed roller and carrying the stopped document toward the transparent panel of the document processor;

document conveying means for conveying the document carried by said resist roller pair to a predetermined position on the transparent panel and discharging the document to the transparent panel; and controlling means for actuating and controlling said forwarding means, said document separating means, said resist roller pair, and said document conveying means, said controlling means responsive to a copy start signal, for energizing said pressing mechanism of said forwarding means, actuating said forwarding roller, and actuating said document separating means to carry the document on said document bearing means, and further responsive to the front end of the document passing through said document separating means for deenergizing said pressing mechanism of said forwarding means for a predetermined time not greater than the time required for the front end of the document to reach said resist roller pair and then again energizing said pressing mechanism.

2. In an automatic document feeder for a document processor having a transparent panel for placement thereon of a document to be processed, said automatic document feeder including document bearing means for bearing documents to be processed, a forwarding roller for forwardly delivering documents borne on said document bearing means, a pressing mechanism for pressing documents at the time of document delivery by said forwarding roller, document separating means including a paper feed roller disposed downstream of said pressing mechanism and a separating mechanism disposed opposite said paper feed roller, a resist roller pair disposed downstream of said document separating means for temporarily stopping a document fed by said paper feed roller and carrying the document toward the transparent panel, and document conveying means for conveying the document carried by said resist roller pair to a predetermined position on the transparent panel, a method of feeding documents comprising the steps of:

(a) detecting a copy start signal;

(b) energizing said pressing mechanism, actuating said forwarding roller, and actuating said document separating means to carry a document from said document bearing means to said resist roller pair;

(c) detecting the front end of the document passing through said document separating means;

(d) deenergizing said pressing mechanism for a predetermined time not greater than the time required for the front end of the document to reach said resist roller pair;

(e) at the predetermined time, again energizing said pressing mechanism;

(f) actuating said resist roller pair to carry the document toward the transparent panel; and (g) actuating said document conveying means to convey the document to the predetermined position on the transparent panel.

* * * * *